US008439208B2

(12) United States Patent
Niederhuefner et al.

(10) Patent No.: US 8,439,208 B2
(45) **Date of Patent: *May 14, 2013**

(54) RETAIL MERCHANDISE HOOK

(75) Inventors: Joerg Niederhuefner, Altenmedingen (DE); Todd C. Westberg, Cherry Valley, IL (US); Stanley C. Valiulis, Rockford, IL (US); Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/545,132

(22) Filed: Jul. 10, 2012

(65) Prior Publication Data

US 2012/0273434 A1 Nov. 1, 2012

Related U.S. Application Data

(63) Continuation of application No. 12/718,015, filed on Mar. 5, 2010, now Pat. No. 8,240,486.

(51) Int. Cl.
*B42F 17/02* (2006.01)
*A47F 5/08* (2006.01)

(52) U.S. Cl.
USPC ..... 211/51; 211/59.1; 248/225.21

(58) Field of Classification Search ..... 211/7, 51, 211/54.1, 57.1, 59.1, 59.2, 59.3, 106, 106.01; 248/220.22, 220.31, 220.41, 225.21, 301, 248/304

See application file for complete search history.

(56) References Cited

U.S. PATENT DOCUMENTS

| | | | |
|---|---|---|---|
| 3,848,745 | A | 11/1974 | Smith |
| 4,289,242 | A | 9/1981 | Kenyon |
| 4,475,658 | A | 10/1984 | Roberts |
| 4,712,694 | A | 12/1987 | Breslow |
| 4,742,923 | A | 5/1988 | Calvert |
| 4,821,894 | A | 4/1989 | Dechirot |
| 4,830,201 | A | 5/1989 | Breslow |
| 4,836,390 | A | 6/1989 | Polvere |
| 4,887,737 | A | 12/1989 | Adenau |
| 4,899,668 | A | 2/1990 | Valiulis |
| 4,901,869 | A | 2/1990 | Hawkinson et al. |
| 5,009,334 | A | 4/1991 | Bodkins |

(Continued)

FOREIGN PATENT DOCUMENTS

| | | | |
|---|---|---|---|
| DE | 20 2005 010088 | U1 | 9/2005 |
| EP | 0 868 871 | A1 | 10/1998 |

(Continued)

OTHER PUBLICATIONS

The POS—Product Pusher; website http://www.postuning.de/69.0.html?&L=2 ; date last visited Mar. 29, 2006, 1 page.

(Continued)

*Primary Examiner* — Darnell Jayne
*Assistant Examiner* — Joshua Rodden
(74) *Attorney, Agent, or Firm* — Reinhart Boerner Van Deuren P.C.

(57) ABSTRACT

A pusher is provided. The pusher hook has a track and a pusher that is slidable thereon. The pusher biases retail merchandise situated on a merchandise hook forward towards a front stop. The pusher hook further includes a security frame that reduces or restricts entirely the ability to remove the merchandise laterally from the hook.

18 Claims, 13 Drawing Sheets

U.S. PATENT DOCUMENTS

| | | | |
|---|---|---|---|
| 5,114,021 | A | 5/1992 | Fredrickson |
| 5,161,704 | A | 11/1992 | Valiulis |
| 5,222,608 | A | 6/1993 | Eklof et al. |
| 5,240,126 | A | 8/1993 | Foster et al. |
| 5,265,738 | A | 11/1993 | Yablans et al. |
| 5,641,077 | A | 6/1997 | Tufano et al. |
| 5,671,851 | A | 9/1997 | Johnson et al. |
| 5,685,664 | A | 11/1997 | Parham et al. |
| 5,690,238 | A | 11/1997 | Schmehr |
| 5,839,588 | A | 11/1998 | Hawkinson |
| 5,855,282 | A | 1/1999 | Hardy |
| 5,906,283 | A | 5/1999 | Kump et al. |
| 5,971,173 | A | 10/1999 | Valiulis et al. |
| 6,041,720 | A | 3/2000 | Hardy |
| 6,082,558 | A | 7/2000 | Battaglia |
| 6,102,192 | A | 8/2000 | Tomuro et al. |
| 6,105,791 | A | 8/2000 | Chalson et al. |
| 6,109,458 | A | 8/2000 | Walsh et al. |
| 6,129,218 | A | 10/2000 | Henry et al. |
| 6,131,748 | A | 10/2000 | Kawasaki et al. |
| 6,158,598 | A | 12/2000 | Josefsson |
| 6,286,690 | B1 | 9/2001 | Thalenfeld |
| 6,409,028 | B2 | 6/2002 | Nickerson |
| 6,474,478 | B1 | 11/2002 | Huehner et al. |
| D472,331 | S | 3/2003 | Zadak |
| D480,231 | S | 10/2003 | Valiulis et al. |
| 6,659,291 | B2 | 12/2003 | Huehner et al. |
| 6,769,552 | B1 | 8/2004 | Thalenfeld |
| 6,820,754 | B2 | 11/2004 | Ondrasik |
| 6,824,009 | B2 | 11/2004 | Hardy |
| 6,886,699 | B2 | 5/2005 | Johnson et al. |
| 6,889,854 | B2 | 5/2005 | Burke |
| 6,923,330 | B1 | 8/2005 | Nagel |
| 6,964,235 | B2 | 11/2005 | Hardy |
| 7,007,810 | B2 | 3/2006 | Huehner et al. |
| 7,293,663 | B2 | 11/2007 | Lavery, Jr. |
| 7,395,938 | B2 | 7/2008 | Merit et al. |
| 7,533,784 | B2 | 5/2009 | Vlastakis et al. |
| 7,566,037 | B2 | 7/2009 | Vogler |
| 7,905,364 | B2 | 3/2011 | Pail |
| 2002/0108916 | A1 | 8/2002 | Nickerson |
| 2003/0029816 | A1 | 2/2003 | Huehner et al. |
| 2003/0057167 | A1 | 3/2003 | Johnson et al. |
| 2004/0084386 | A1 | 5/2004 | Huehner et al. |
| 2005/0040123 | A1 | 2/2005 | Ali |
| 2005/0056602 | A1 | 3/2005 | Hardy |
| 2005/0168345 | A1 | 8/2005 | Swafford, Jr. et al. |
| 2005/0189309 | A1 | 9/2005 | Hardy |
| 2005/0279722 | A1 | 12/2005 | Ali |
| 2006/0049122 | A1 | 3/2006 | Mueller et al. |
| 2006/0226095 | A1 | 10/2006 | Hardy |
| 2007/0251900 | A1 | 11/2007 | Hardy |
| 2007/0267364 | A1 | 11/2007 | Barkdoll |
| 2007/0267367 | A1 | 11/2007 | Mueller et al. |
| 2008/0203253 | A1 | 8/2008 | Vogler |
| 2008/0309489 | A1 | 12/2008 | Hachmann et al. |
| 2009/0101606 | A1 | 4/2009 | Olson |
| 2010/0012602 | A1 | 1/2010 | Valiulis et al. |
| 2010/0200526 | A1 | 8/2010 | Barkdoll |
| 2011/0215060 | A1 | 9/2011 | Niederhuefner |
| 2011/0215061 | A1 | 9/2011 | Niederhuefner et al. |
| 2011/0218889 | A1 | 9/2011 | Westberg et al. |

FOREIGN PATENT DOCUMENTS

| | | | |
|---|---|---|---|
| EP | 1 256 296 | A2 | 11/2002 |
| EP | 1 541 064 | A1 | 6/2005 |
| EP | 1 541 064 | B1 | 2/2006 |
| GB | 2 304 102 | A | 3/1997 |
| GB | 2 360 514 | A | 9/2001 |
| WO | WO 91/03967 | A1 | 4/1991 |
| WO | WO 2004/083051 | A2 | 9/2004 |

OTHER PUBLICATIONS

The POS—Systemtray; website http://www.postuning.de/68.0.html?L=2 ; date last visited Mar. 29, 2006, 1 page.

RETAIL MERCHANDISE HOOK

CROSS-REFERENCE TO RELATED PATENT APPLICATIONS

This patent application is a Continuation of co-pending U.S. patent application Ser. No. 12/718,015 filed Mar. 5, 2010, the entire teachings and disclosure of which are incorporated herein by reference thereto.

FIELD OF THE INVENTION

This invention generally relates to retail display systems and more specifically to pusher systems for facing retail merchandise.

BACKGROUND OF THE INVENTION

It is well established that presenting merchandise in a neat, accessible, and aesthetically pleasing manner can increase sales. Retailers typically employ a variety of retail display systems to accomplish effective merchandise presentation. Many of these methods are aimed at automation as well as security. Indeed, loss prevention, i.e. the reduction or prevention of retail theft, is a design parameter often contemplated in the design of retail display systems.

One such retail display system, a pusher system, is used to "face" merchandise, i.e. bias the merchandise to the leading edge of a retail shelf. A general description of a typical pusher system may be found at U.S. Pat. App. Pub. No. 2007/0267364 A1, the teachings and disclosure of which are hereinafter incorporated by reference.

A typical pusher system contains merchandise in an organized line or row. As a front most item is removed, a pusher of the pusher system biases the entire line or row forward such that the next item in the line or row, now the front most item, is biased forward until it engages a stop of the pusher system that prevents further movement of the item. As a result, the pusher system presents retail merchandise in a neat and accessible manner by maintaining the same in a linear row upon a shelf while also locating the merchandise at a highly accessible point.

Increasing retail sales through effective presentation has created a demand for the incorporation of pushers and like in retail displays not otherwise incorporating a shelf. However, certain displays have presented challenges to incorporating a pusher. One example is the retail display hook. Retail display hooks typically include a rod or wire extending away from a support structure in a cantilevered manner. Merchandise is hung from the hook, and can be removed by sliding the merchandise off an end of the hook.

Unfortunately, a pusher system used with a retail hook presents several problems. As one example, the biasing action of the pusher can create an undesirable outward lean in the merchandise situated on the hook. The outward lean of the merchandise tends to make the merchandise appear disorganized. As another example, several items of retail merchandise hanging from the hook are more easily removed in a single operation under the assistance of the pusher, allowing for a heightened vulnerability to retail theft.

The present invention is directed toward an improved retail hook that may or may not employ self facing technology that improves upon one or more deficiencies in the art.

BRIEF SUMMARY OF THE INVENTION

The present invention has several aspects that may be claimed and stand as patentable independently and individually or in combination with other aspects. Some aspects are summarized below, while others may be developed in the remainder of the disclosure.

In one aspect, an embodiment of the invention provides a retail merchandise hook that self faces retail merchandise situated thereon. The retail merchandise hook includes a hook for hanging retail merchandise therefrom and a front stop separate from and arranged in spaced relation to the hook. The retail merchandise hook also includes a pusher movable relative to the hook and operable to bias retail merchandise hanging from the hook into engagement with the front stop.

In another aspect, an embodiment of the invention provides a retail merchandise hook that offers enhanced security by reducing or eliminating the ability to remove multiple items simultaneously therefrom. The retail merchandise hook includes a hook for hanging retail merchandise therefrom, and a security structure configured to restrict side removal of retail merchandise from the hook to removal from an end of the hook. The security structure includes at least one product retainer disposed on at least one lateral side of the hook and that extends at least partially below the hook. The product retainers are arranged to prevent or limit lateral movement of product hanging on the hook while permitting forward and backward movement of product on the hook.

In yet another aspect, an embodiment of the invention provides a retail merchandise hook that self faces retail merchandise while offering enhanced security. The retail merchandise hook includes a hook for hanging retail merchandise therefrom, and a front stop arranged to stop retail merchandise proximate a front end of the hook. The retail merchandise hook also includes a pusher assembly comprising a support structure either above or below the hook, a housing surrounding the support structure, and a pusher housing a spring therein. The housing defines a track with a slide surface along which the pusher is linearly translatable. The pusher is acted upon by the spring to urge the pusher toward the front stop. A mounting bracket is also provided that commonly carries the wire hook and the wire structure.

In yet another aspect, an embodiment of the invention provides a retail merchandise hook that incorporates an adjustable pusher. The retail merchandise hook includes a hook for hanging retail merchandise therefrom, and a pusher movable relative to the hook and operable to bias retail merchandise forward. The pusher is adjustable such that a portion of the pusher has a variable length.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
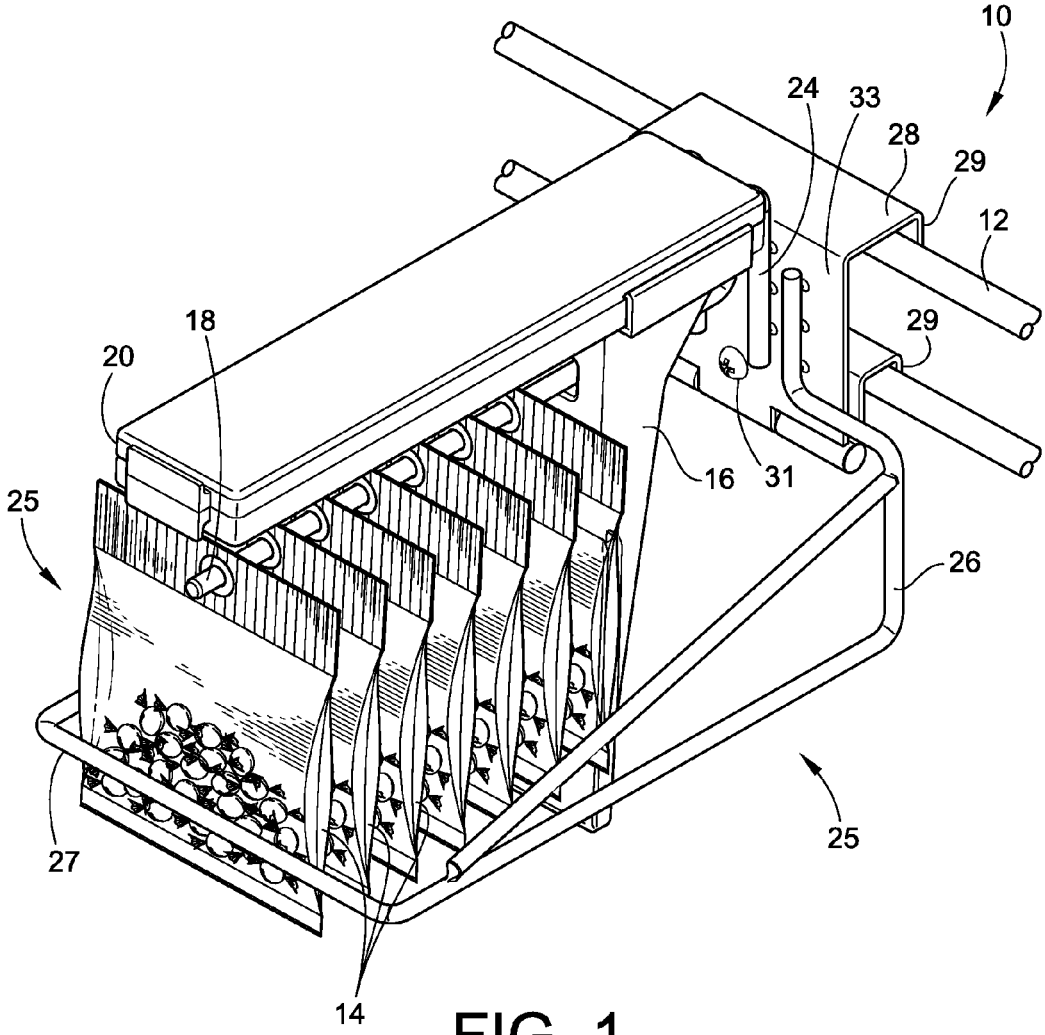
FIG. 1 is a perspective view of an exemplary embodiment of a retail display hook in the form of a pusher hook for front facing retail merchandise according to the teachings of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, exemplary embodiments of a retail merchandise hook in the form of a pusher hook are illustrated. In the illustrated embodiment of FIG. 1, a pusher hook 10 is mounted upon a retail support structure 12. Retail merchandise 14 is situated on a merchandise hook 18 of the pusher hook 10.

The pusher hook 10 includes a pusher assembly that comprises the pusher 16, and a housing 20 carrying or forming a track that the pusher 16 slidably rides upon. The pusher hook 10 also includes a wire assembly that includes the hook 18, a support wire 24 for supporting the housing 20, and a security frame 26 that restricts removal of the merchandise 14 from the merchandise hook 18 to an end thereof.

As will be explained in greater detail below, the pusher assembly of the pusher hook 10 biases, i.e. self faces, a linear row of the retail of merchandise 14 toward a distal end of the merchandise hook 18. As the leading item of retail merchandise 14 is removed from a distal end of the hook 18, the pusher 16 biases the remaining items of retail merchandise 14 forward so that the next item of retail merchandise 14 is now the leading item of retail merchandise 14, and is situated at or approximate to the distal end of the hook 18. The leading item makes contact with a front stop 27. The pusher 16 biases the row of merchandise 14 into the front stop 27 such that the merchandise 14 is presented in a generally vertical or upright fashion, and generally without an undesirable forward lean. Moreover, the pusher assembly and front stop 27 cooperate to ensure that a generally minimal amount of retail merchandise 14 may be removed from the hook 18 in a single operation.

The support wire 24, security frame 26, and merchandise hook 18, are commonly mounted to a mounting bracket 28. It will be recognized from the following that one advantage of commonly mounting the support wire 24, security frame 26, and merchandise hook 18 to the mounting bracket is the ability to quickly install the pusher hook 10 on a retail structure 12 using a minimal amount of assembly operations. Moreover, the mounting bracket 28 can take numerous forms depending on the retail support structure 12 that the pusher hook 10 will mount upon. For example, it is understood that the pusher hook 10 can be configured to mount to slat walls, peg boards, wire structures, point of purchase displays, etc., depending upon the particular design selected for the mounting bracket 28.

Figure 2:
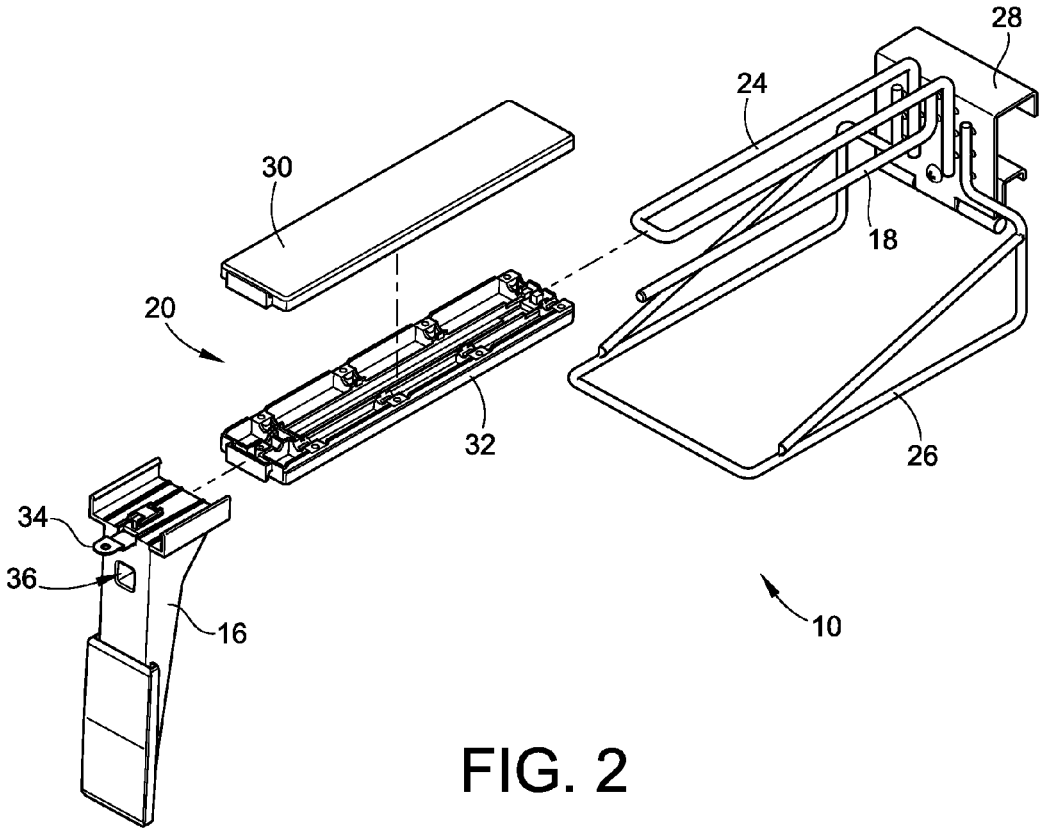
FIG. 2 is an exploded perspective view of the pusher hook of FIG. 1.
Figure 11:
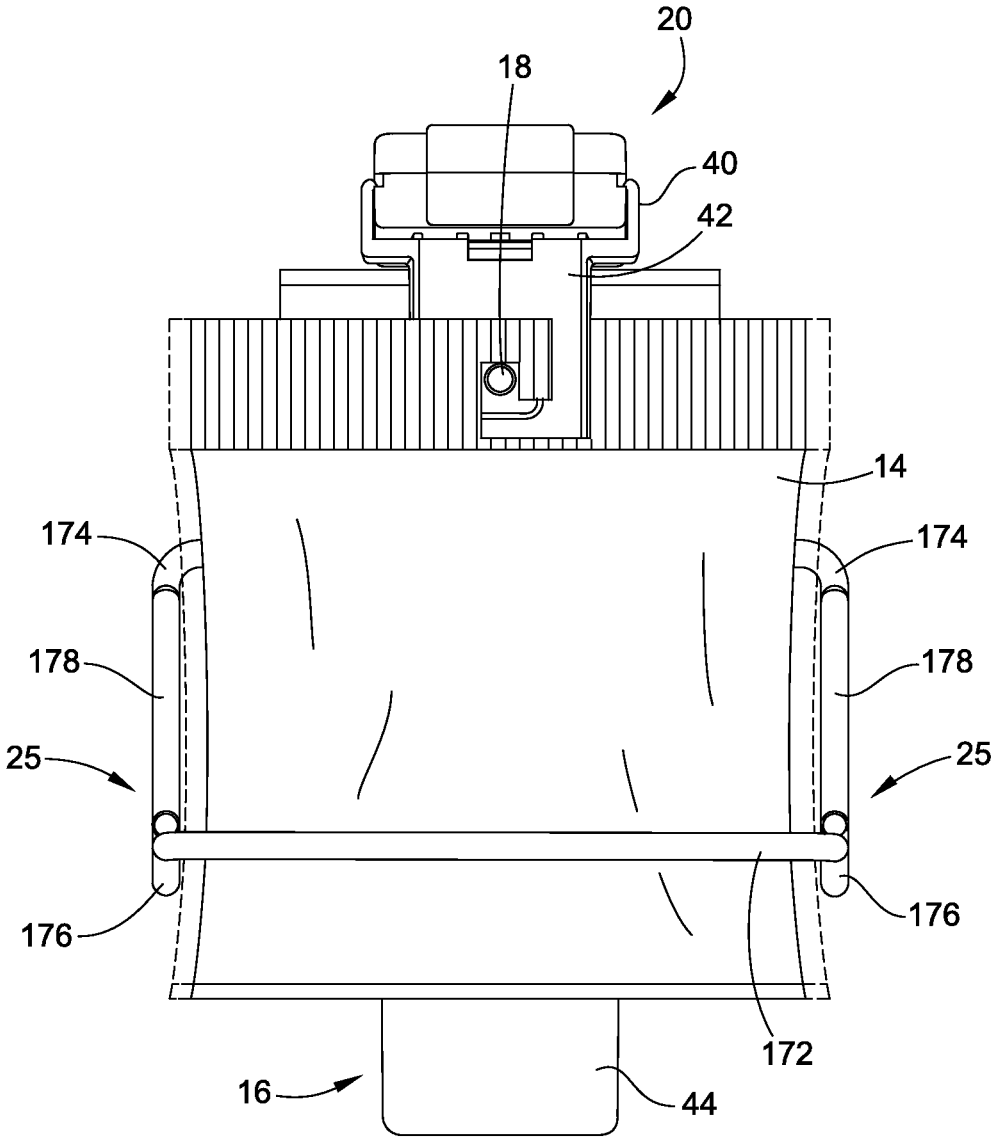
FIG. 11 is a front view of the pusher hook of FIG. 10.

Referring to FIGS. 1, 2, and 11, certain types of retail merchandise packaging typically has a hole (see FIG. 1) used to hang the retail merchandise from the hook 18. Certain other types of retail merchandise packaging incorporate a hook shape (see FIG. 11) also used to hang the retail merchandise from the hook 18. When the latter is used, there is a risk that multiple items can quickly be removed laterally from a side of the hook 18, as opposed to one by one from the end of the hook 18, during a particular type of retail theft known as "sweeping".

The security frame 26 incorporates at least one product retainer 25 that reduces or prevents the ability to sweep multiple items from the hook 18. More specifically, and with particular reference to FIG. 11, a pair of product retainers 25 generally restrict removal of retail merchandise 14 to removal from an end of the hook 18 as opposed to a side of the hook. The biasing force created between the pusher assembly and the front stop 27 generally reduces the amount of retail merchandise that may be removed from the hook 18 in a single removal operation. For example, in one embodiment, the front stop 27 and pusher assembly may cooperatively operate to restrict removal of merchandise 14 to a single item at a time. However, in other embodiments, removal of more than one item of merchandise 14 is contemplated.

Referring now to FIGS. 1 and 2, the pusher assembly includes a pusher 16. The pusher 16 rides along the housing 20 and is biased towards a distal end of the merchandise hook 18 by a biasing element 34. As the pusher 16 is biased by the biasing element 34, retail merchandise 14 situated on the retail hook 18 ahead of the pusher 16 is biased forward, thereby presenting a consumer with a neat and organized arrangement of retail merchandise.

Figure 3:
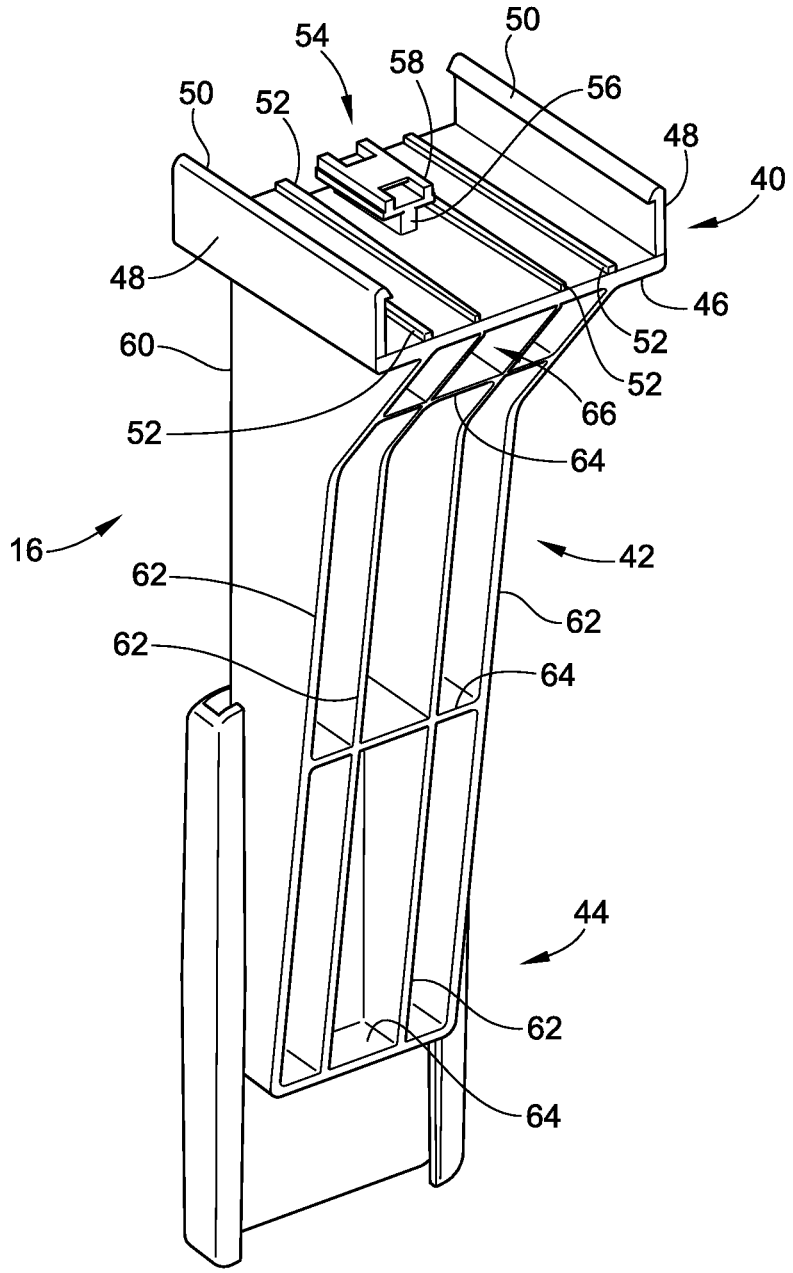
FIG. 3 is a perspective view of a pusher of the pusher hook of FIG. 1.
Figure 4:
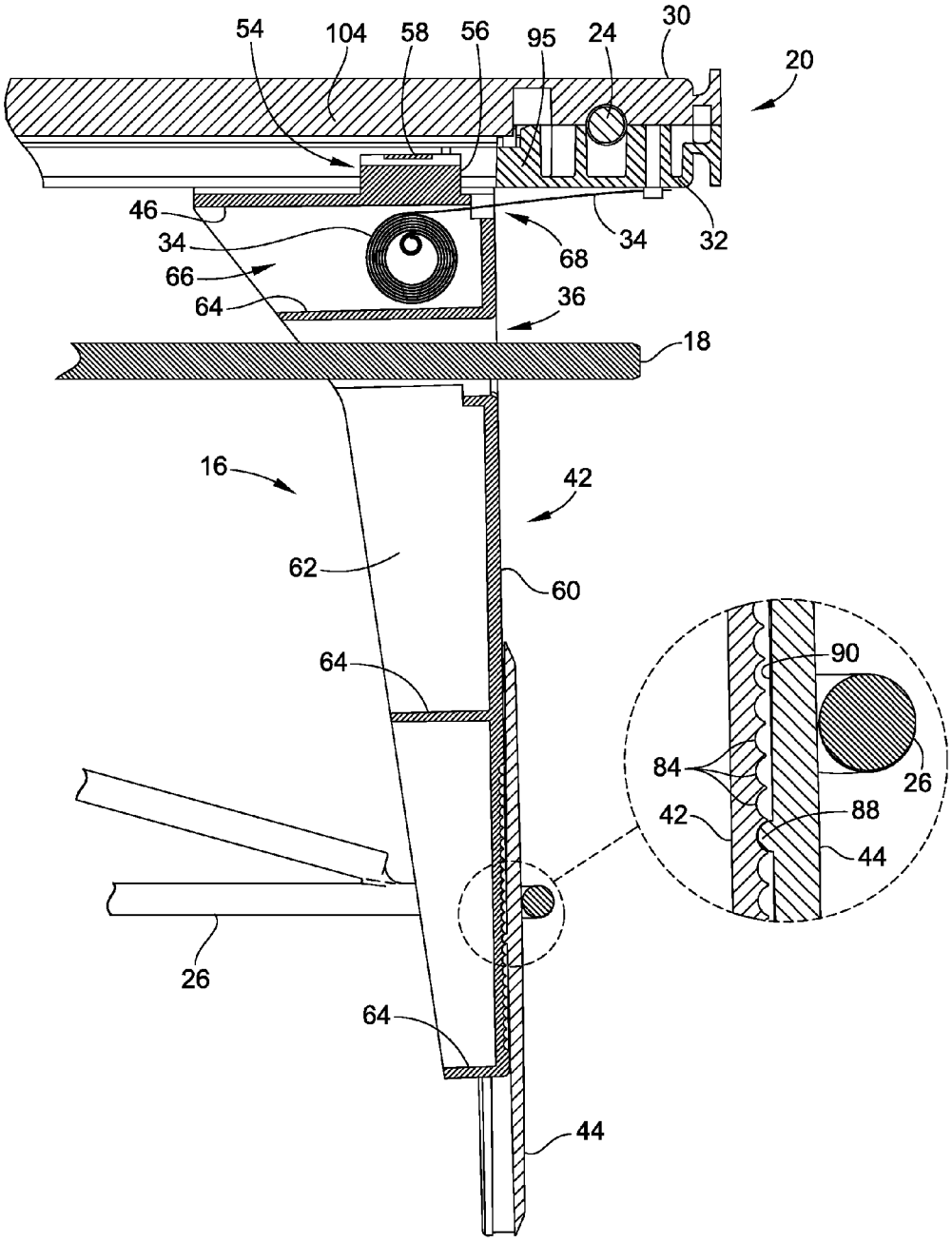
FIG. 4 is a partial side cross section of a front portion of the pusher hook of FIG. 1.
Figure 5:
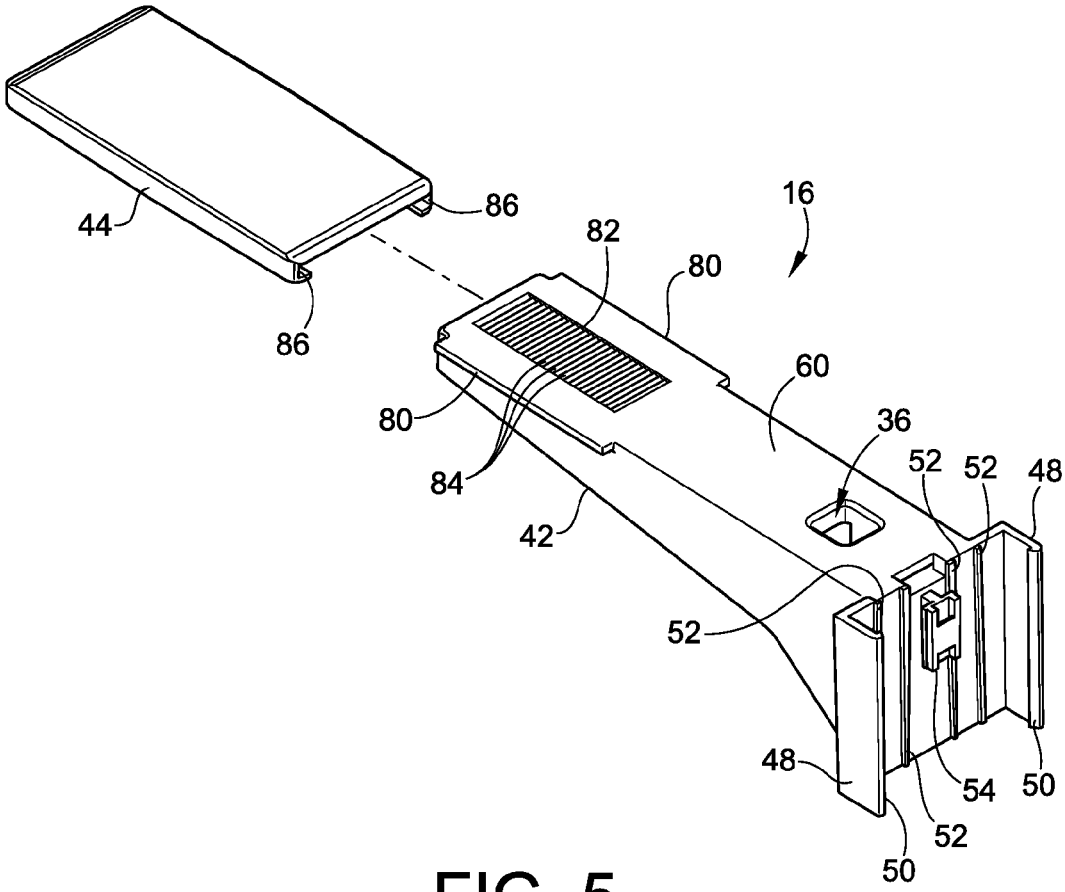
FIG. 5 is an exploded perspective view of a paddle and paddle extension of the pusher hook of FIG. 4.

With reference to FIGS. 3, 4, and 5, the pusher 16 has a base 40 and a paddle 42 that extends away from the base 40. The paddle 42 slidably receives a paddle extension 44. The paddle extension 44 is adjustable to selectively increase the overall length of the pusher 16. By selectively adjusting the length of the pusher 16, the pusher hook 10 can operate upon various sizes of retail merchandise. More particularly, the overall length of the pusher 16 can be varied such that a substantial portion of the retail merchandise 14 (see FIG. 1) is in contact with the pusher 16.

With reference to FIG. 3, the base 40 has a bottom wall 46 and a pair of side walls 48 extending therefrom. Each side wall 48 has a guide rib 50 formed therein. As will be explained in greater detail below, the guide ribs 50 function to guide the pusher 16 relative to the housing 20 (see FIG. 2).

A plurality of slides 52 extend upwardly from the bottom wall 46. The slides 52 contact an outer surface of the housing 20 (see FIG. 2) during normal operation. The slides 52 function to reduce the surface contact between the pusher 16 and the housing 20, and more particularly, function to reduce the surface contact between the base 40 and the housing 20.

A T-shaped track retainer 54 extends upwardly away from the bottom wall 46 of the base 40. The track retainer 54 guides the pusher 16 relative to the housing 20. The track retainer 54 has a neck portion 56 and a flange 58 generally wider then the neck portion 56. As will be explained in greater detail below, the neck portion 56 extends through a channel of the housing 20, and the flange 58 is disposed within the housing 20 during normal operation.

The paddle 42 has a front wall 60 and a plurality of vertical support webs 62 and horizontal support webs 64 extending away from the front wall 60. As illustrated in FIG. 3, the outer most vertical support webs 62 define the exterior side walls of the paddle 42. A chamber 66 is formed proximate to the base 40 and between adjacent vertical support webs 62. As will be discussed in greater detail below, the chamber 66 houses the biasing element 34 (see FIG. 2).

Turning now to FIG. 4, the biasing element 34 is contained within the chamber 66. An end of the biasing element 34 extends through a slot 68 and is fixed to the second half 32 of the housing 20. As the pusher 16 is moved away from the distal end of the merchandise hook 18, the biasing element 34 uncoils and is fed out through the slot 68. When unwound, the biasing element 34 will attempt to recoil and pull the pusher 16 back towards the distal end of the merchandise hook 18. As will be explained in greater detail below, the pusher 16 will move back toward the distal end of the merchandise hook 18 until the paddle 42 and/or the paddle extension 44 engages the security frame 26 as illustrated. As a result, the security frame 26 also functions as a front stop of the pusher hook 10.

Although illustrated as a coil spring, the biasing element 34 can take numerous forms. For example, the biasing element could be a resilient member such as an elastic band or belt and provide the same advantages and benefits described herein.

As illustrated, the retail hook 18 is situated below the housing 20. The pusher 16 has an opening 36 therethrough to allow the merchandise hook 18 to freely pass through the pusher 16. The opening 36 allows the pusher 16 to move relative to the merchandise hook 18 and bias retail merchandise 14 (see FIG. 1) forward. As an additional result of the placement of the opening 36, a substantial portion of the pusher 16 is situated below the hook 18.

More specifically, a substantial portion of the paddle 42 and the paddle extension 44 are situated below the hook 18. One particular advantage of the above configuration is that the pusher 16 can remain in contact with a substantial amount of the retail merchandise 14 hanging from and below the hook 18. As a result, the force exerted by the pusher 16 upon the retail merchandise 14 is generally uniform along the length of the merchandise 14.

Turning now to FIG. 5, the paddle extension 44 is slidably received by the paddle 42. To facilitate this functionality, the paddle 42 includes a pair of flanges 80. The paddle extension 44 includes a pair of channels 86 configured to receive the flanges 80 of the paddle 42. The flanges 80 and grooves 86 together cooperate to allow the paddle extension 44 to move linearly relative to the paddle 42 to increase the overall length of the pusher 16.

The paddle 42 also includes an adjustment region 82. The adjustment region 82 has a plurality of grooves 84. The plurality of grooves 84 are arranged in a linear array and extend inwardly into the front wall 60 of the paddle 42. The plurality of grooves 84 define a range of discrete adjustment locations of the paddle extension 44 relative to the paddle 42.

Referring back to FIG. 4, the paddle extension 44 includes a rib 88 extending from an inner surface 90 of the paddle extension 44. The rib 88 is dimensioned to resiliently interlock with a select one of the plurality of grooves 84. The rib 88 and plurality of grooves 84 cooperate such that once the rib 88 is seated within a particular groove 84, the paddle extension 44 will not move relative to the paddle 42. However, the rib 88 and grooves 84 are dimensioned such that the rib 88 may be selectively placed into adjacent ones of the plurality of grooves 84 by applying a sufficient enough force to the paddle extension 44 to bias it from one groove 84 to another groove 84.

It will be recognized that the plurality of grooves 84 and the rib 88 can have various geometrical shapes and are not necessarily limited to those illustrated in FIGS. 4 and 5. For example, the paddle extension 44 and paddle 42 could incorporate a detent and catch arrangement. Moreover, whatever configuration is used, the cooperating structures could be reversed. As another example, the paddle extension 44 could include a plurality of grooves 84 and the paddle 42 could include a rib 88.

Figure 6:
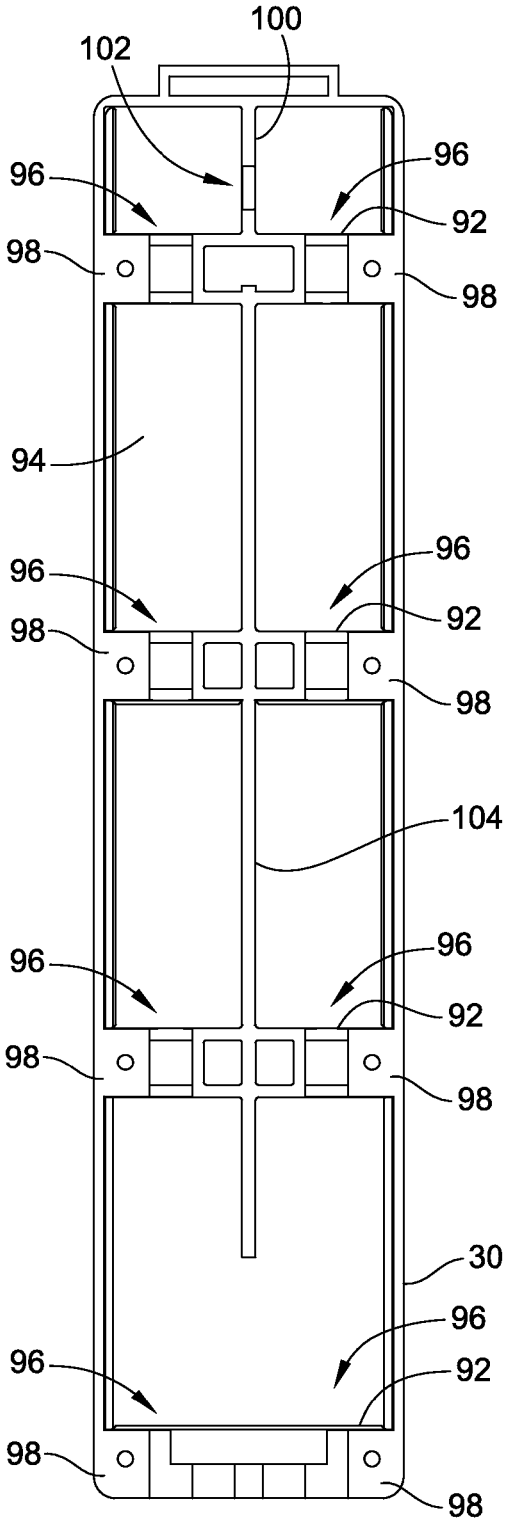
FIG. 6 is an interior view of a first half of a housing of the pusher hook of FIG. 1.
Figure 7:
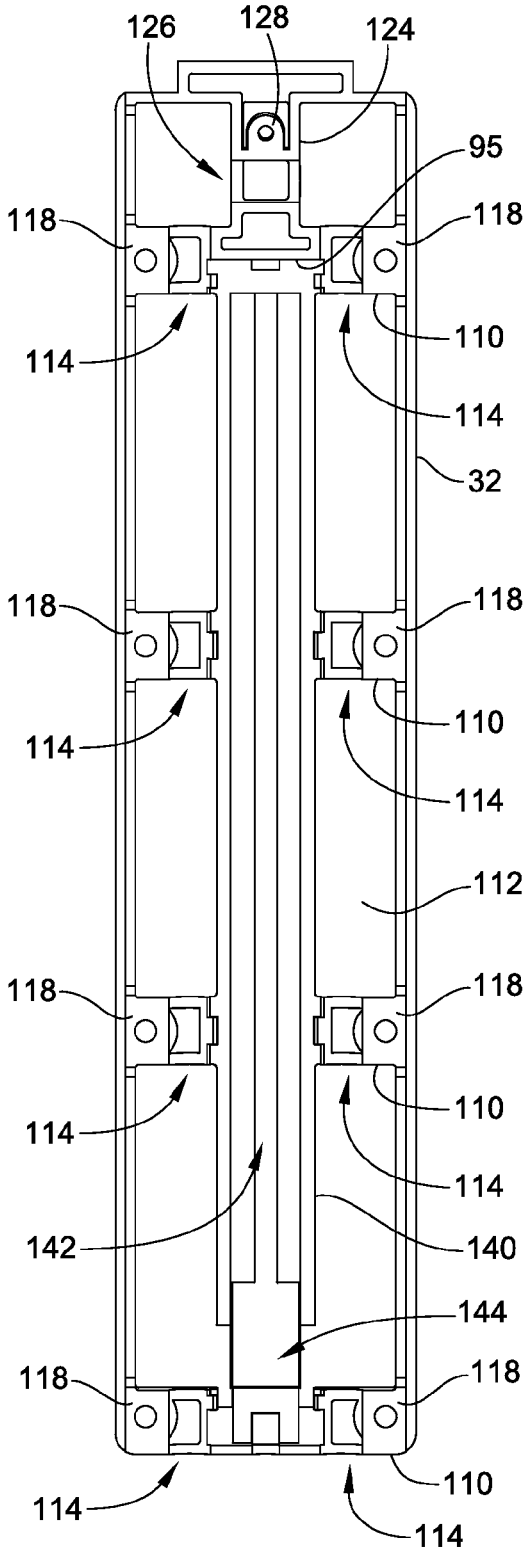
FIG. 7 is an interior view of a second half of a housing of the pusher hook of FIG. 1.

Referring now to FIGS. 6 and 7, the housing has a first and second half 30, 32. The first half 30 of the housing 20 has a plurality of support structures 92 extending from an inner surface 94 of the first half 30. Each support structure 92 has a pair of openings 96. As will be explained in greater detail below, the openings 96 are dimensioned to receive the support wire 24 (see FIG. 1). Each support structure 92 also includes a pair of connection points 98. The connection points 98 correspond to similar connection points of the second half 32 of the housing 20.

The first half 30 of the housing 20 also includes a front support rib 100. The front support rib 100 has an opening 102 therethrough also dimensioned to receive the support wire 24. As a result, the openings 96 of the support structures 92 and the opening 102 of the front support rib 100 together allow the first half 30 of the housing 20 to receive the generally loop-shape of the support wire 24.

The first half 30 of the housing 20 also includes a guide rib 104 extending from the inner surface 94 of the first half 30. The guide rib 104 structurally reinforces the first half 30, while also guiding the track retainer 54. Although illustrated as extending along a portion of the length of the first half 30, the guide rib 104 may be longer or shorter than that illustrated.

Turning now to FIG. 7, the interior of the second half 32 of the housing 20 is illustrated. Similar to the first half 30, the second half 32 also has a plurality of support structures 110. Each support structure 110 has a pair of openings 114. The openings 114 are dimensioned to receive the support wire 24 (see FIG. 1) in a similar manner as the openings 96 of the support structures 92 of the first half 30 (see FIG. 6). Each support structure 110 also includes a pair of connection points 118. The connection points 118 of the second half 32 correspond to the connection points 98 of the first half 30 (see FIG. 6). The connection points 98, 118 align the first half 30 and second half 32 of the housing 20.

The second half 32 of the housing 20 also includes a front support structure 124. The front support structure 124 has an opening 126 therethrough to receive the generally loop-shaped support wire 24 (see FIG. 2). With reference to FIGS. 4 and 7, an interior front stop 95 is formed proximate the front support structure 124. In some embodiments, the interior front stop 95 may be located within the housing 20 such that it engages the track retainer 54 to prevent further forward movement of the pusher 16. In other embodiments, the front stop 27 of the wire assembly (see FIG. 1) prevents further forward movement of the pusher 16. The front support structure 124 also includes a mounting point 128. The mounting point 128 receives a fastener for fastening the biasing element to the bottom half 32 of the housing 20 as discussed above.

Figure 8:
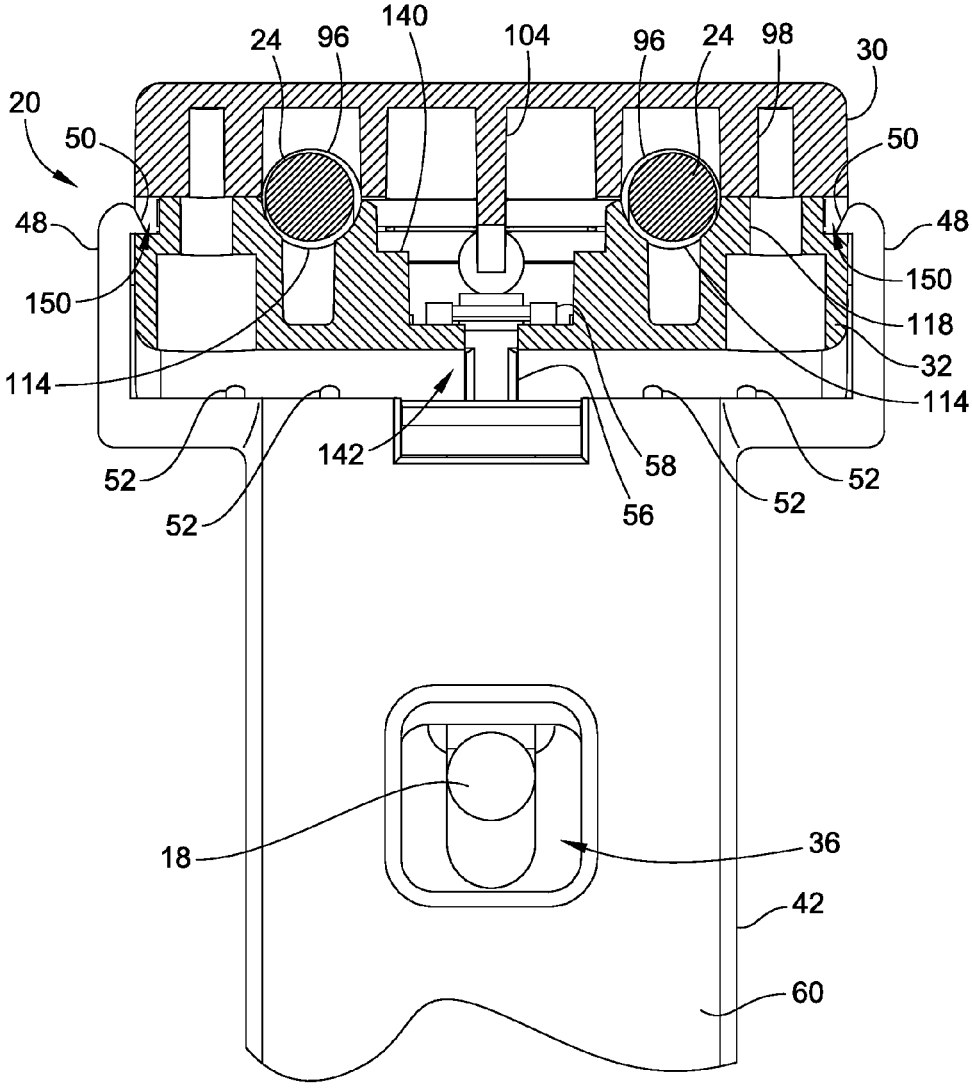
FIG. 8 is a front cross section view of a track of the housing of the pusher hook of FIG. 1.

The second half 32 also has a channel 140 forming a slide surface. The channel 140 has a slot 142 and an opening 144 extending through the inner surface 112 of the second half 32. As will be discussed in greater detail below, the slot 142 is dimensioned to receive the neck 56 of the track retainer 54 (see FIG. 4). Similarly, the opening 144 of the channel 140 is dimensioned to receive the flange 58 of the track retainer 54. With reference to FIG. 8, the neck 56 extends through the slot 142 after the flange has been installed through the opening 144. Once installed, the neck 56 of the track retainer 54 is slidable within the slot 142. However, the flange 58 retains the track retainer 54 within the channel 140 of the bottom half 32 of the housing 20. As a result, the pusher 16 is linearly slidable relative to the housing 20 while being guided by the track retainer 54 and channel 140.

Still referring to FIG. 8, the first and second halves 30, 32 of the housing 20 collectively surround the support wire 24. As discussed above, each half 30, 32 includes openings 96, 114 respectively to allow the support wire 24 to pass therethrough. Also as illustrated, the connection points 98, 118 align and are joined by a fastener to retain the housing 20 upon the support wire 24. In the illustrated embodiment, the connection points 98, 118 together form counter bored holes for a threaded fastener or the like. However, other fasteners are contemplated, e.g. rivets or an adhesive.

The housing 20 also includes a pair of longitudinally extending guide grooves 150. The guide grooves 150 receive the guide ribs 50 of the pusher 16. The guide ribs 50 are slidable within the grooves 150. Accordingly, the grooves 150 and guide ribs 50 as well as the track retainer 54 and slot 142 act to linearly guide the pusher 16 relative to the housing 20. As illustrated in FIG. 8, the slides 52 of the pusher 16 contact the bottom half 32 of the housing 20 to further encourage this sliding functionality with a reduced amount of drag due to the reduced surface contact therebetween.

Figure 9:
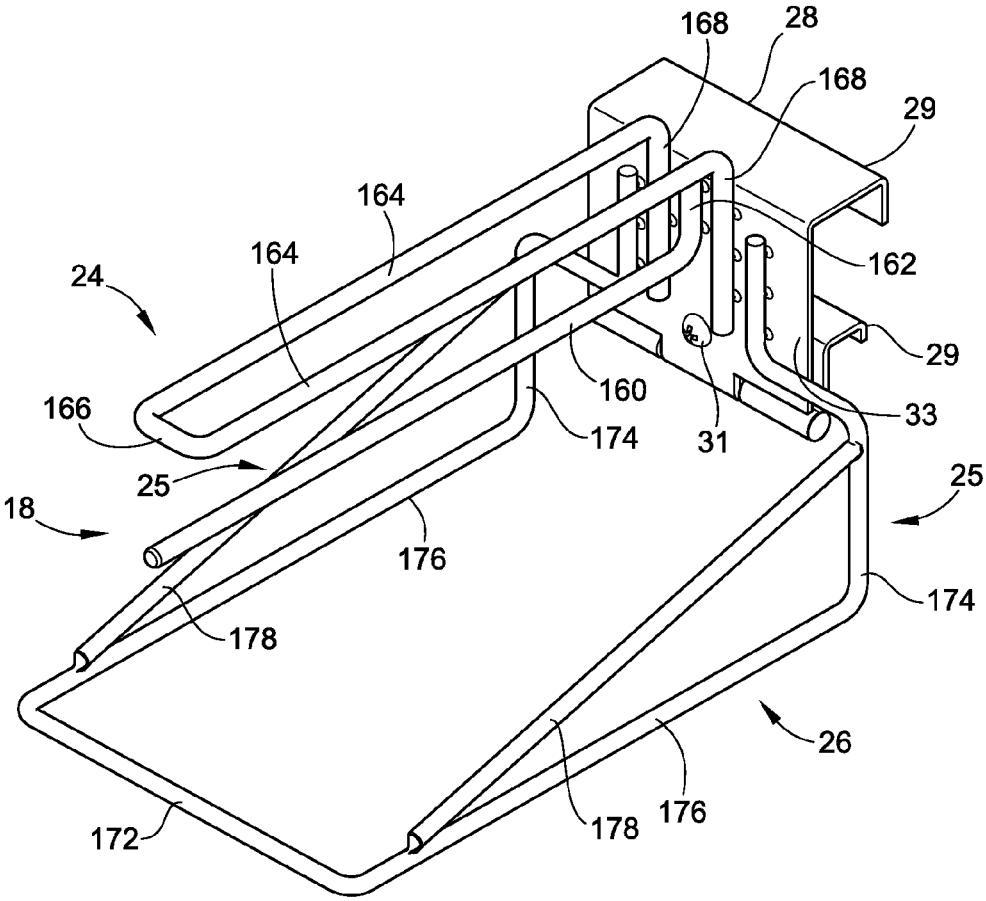
FIG. 9 is a perspective view of a merchandise hook, support wire, and security frame commonly mounted to a mounting bracket of the pusher hook of FIG. 1.

Turning now to FIG. 9, the pusher hook 10 may include a wire assembly having three separate wire structures including the retail hook 18, the support wire 24 forming a support structure, and the security frame 26 forming a security structure, each commonly extending away from the mounting bracket 28. The support wire 24 is generally disposed above the retail merchandise hook 18, and a portion of the security frame 26 is generally below the merchandise hook 18. The hook 18, support wire 24, and security frame 26 are commonly mounted to the mounting bracket 28. As a result, the pusher hook 10 may be quickly installed on a particular retail structure 12 (see FIG. 1) as a single unit, without the need to mount multiple components on the retail structure 12.

The merchandise hook 18 has an elongated segment 160 and a weld segment 162 extending transversely away from the elongated segment 160. The weld segment 162 is welded in place to the mounting bracket 28.

Similarly, the support wire 24 has a pair of parallel elongated segments 164 joined by a loop 166. A weld segment 168 extends transversely away from each parallel elongated segment 164 of the support wire 24. Similar to the merchandise hook 18, the weld segments 168 are welded in place to the mounting bracket 28. Although illustrated and described as being welded in place, the support wire 24 and merchandise hook 18 may be joined to the mounting bracket by various other means including fasteners, clamps, adhesives, etc.

With reference to FIGS. 1 and 9, the security frame 26 may include at least one product retainer 25. In the illustrated embodiment, the security frame 26 has a pair of laterally spaced product retainers 25 and a front wire segment 172 between the product retainers 25 forming the front stop as describe above. In the illustrated embodiment, a wire structure forms each laterally spaced product retainer 25 and the front stop 27, however other structures are contemplated, as described below.

In the illustrated embodiment, the wire structures have a back segment 174 and a bottom wire segment 176 extending transversely away from the back segment 174. A top wire segment 178 extends between the back segments 174 and bottom wire segment 176 such that the product retainers 25 have a diminishing span. Although, the product retainers 25 are illustrated as converging with a diminished span, the top wire segments 178 may extend the full length of the bottom wire segments 176 in other embodiments. Similar to the merchandise hook 18 and support wire 24, the security frame 26 is welded in place to the mounting bracket 28. However, in other embodiments, various other means of mounting the security frame to the mounting bracket 28 are contemplated. For example, the security frame 26 may be attached to the mounting bracket 28 by fasteners, clamps, adhesives, etc.

Figure 10:
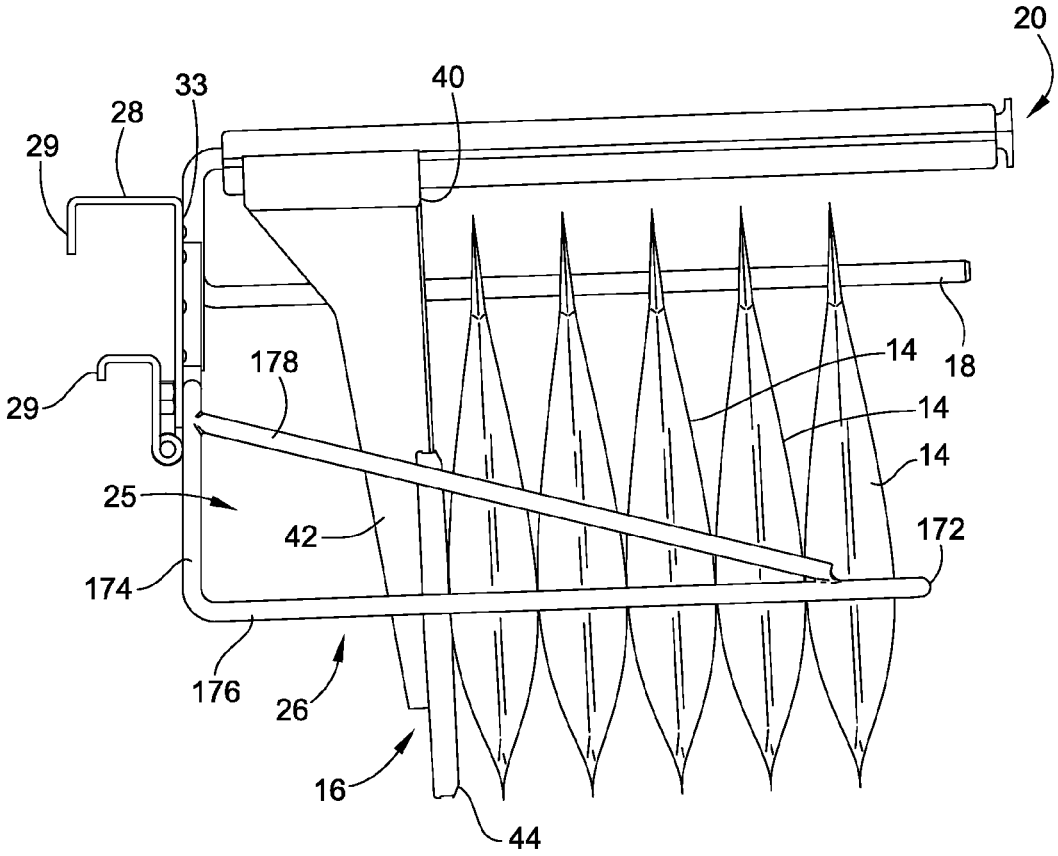
FIG. 10 is a side view of the pusher hook of FIG. 1.

Turning now to FIGS. 10 and 11, the merchandise hook 18 extends beyond the front wire segment 172 relative to the mounting bracket 28. As illustrated in FIG. 10, retail merchandise 14 situated on the merchandise hook 18 will contact the front wire segment 172 before reaching the end of the merchandise hook 18. As a result, the pusher 16 cannot freely bias the merchandise 14 off the end of the merchandise hook 18. As a further result, the merchandise 14 is maintained in a generally vertical or upright position. The front wire segment 172 and the distal end of the merchandise hook 18 are spaced apart such that generally one item of merchandise 14 may be removed from the merchandise hook 18 at a time. However, in other embodiments the merchandise hook 18 and front wire segment 172 spacing may be such that more than one item may be removed at a time.

It will be recognized from inspection of FIG. 10 that the wire structures forming the laterally spaced product retainers 25 generally encompass a substantial portion of the merchandise. As a result, the laterally spaced product retainers 25 prevent or substantially reduce the ability to remove the merchandise 14 laterally or from a side of the hook 18 as opposed to removing it from the distal end of the hook 18. For example, if one would attempt to push merchandise 14 laterally off the hook, the wire structures forming the product retainers 25 would prevent the merchandise 14 from removal, as shown by the dashed lines in FIG. 11.

The spacing of the product retainers 25 is such that lateral movement of the merchandise 14 relative to the merchandise hook 18 is reduced or restricted entirely. As illustrated in FIG. 11, each laterally spaced product retainer 25 will engage the merchandise 14 when an attempt is made to move it laterally relative to the merchandise hook 18. As a result, the retail merchandise 18 is removable from a distal end of the merchandise hook 18 as discussed above. Accordingly, the ability to remove multiple items by grabbing them simultaneously and removing them laterally from the hook during a retail theft incident is reduced or prevented entirely by the security frame 26 and more particularly the laterally spaced product retainers 25.

Figure 13:
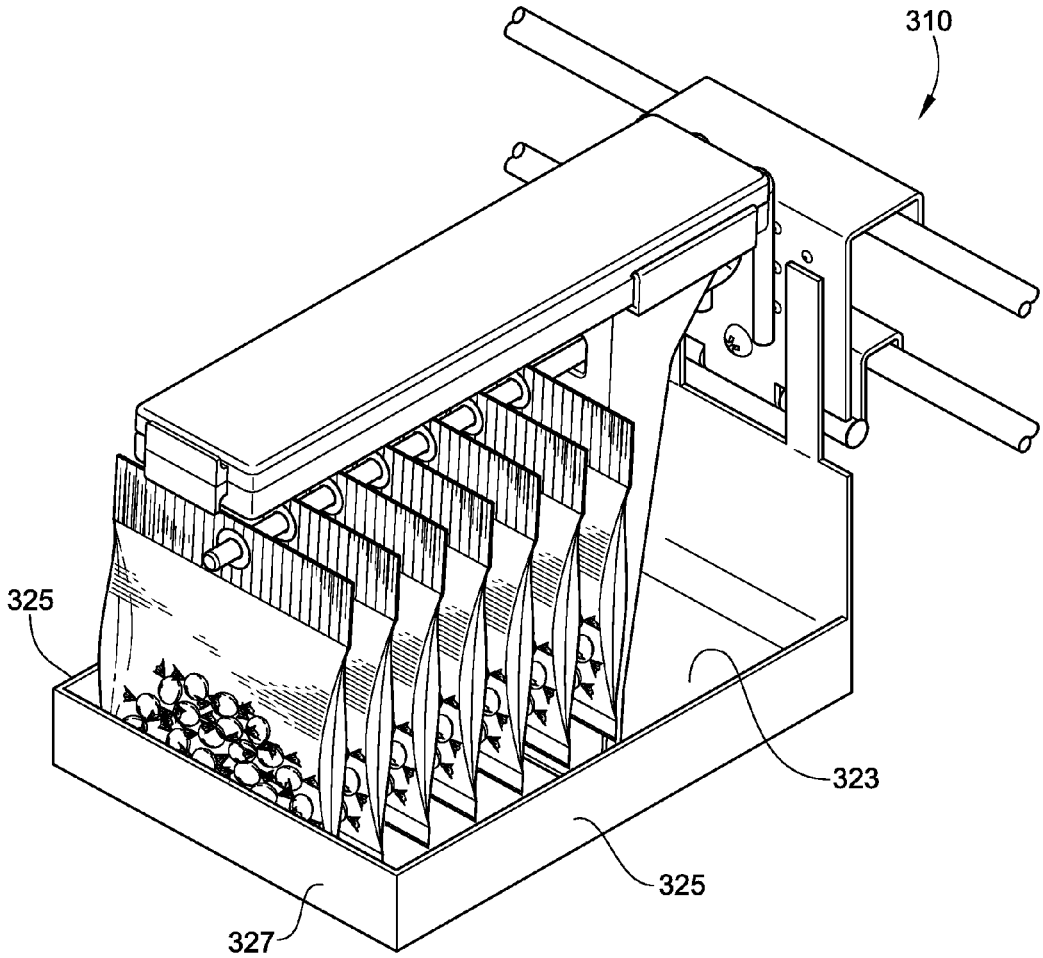
FIG. 13 is perspective view of an alternative embodiment of the pusher hook of FIG. 1.

Although illustrated as a wire frame, the security frame 26 can take various other forms. Indeed, and as will be more fully understood from the following, the security frame 26 can have various structural configurations not limited to a wire structure and still achieve the benefits of a security structure as described herein. For example, and with reference to FIG. 13, an alternative embodiment of a retail merchandise hook 310 is illustrated. In the illustrated embodiment, the security frame is a bin or other similar structure having solid and continuous side walls 325 forming product retainers and a bottom 323. The bin also has a front wall 327 forming a front stop. Such a configuration would still provide the front stop capability as well as the lateral removal constraints as described above. The bin could be made of plastic or any other rigid material. Accordingly, various structures are contemplated that will provide a product retainer and a front stop and are not limited to the illustrations provided.

Referring now to FIGS. 1, 9, 10, the illustrated mounting bracket 28 has at least one mounting prong 29 extending from a base plate 33. In the illustrated embodiment, a pair of mounting prongs 29 are utilized, however in other embodiments more or fewer mounting prongs 29 are contemplated. Additionally, the mounting prongs 29 may take a variety of forms to facilitate mounting to a given support structure 12.

The base plate 33 of the mounting bracket 28 has a generally flat, rectangular shape. The weld segments 162, 168 and the back segment 174 are welded to the base plate 33. However, and as described above, other fastening means are contemplated. The mounting bracket 28 may also incorporate a security feature, such as a screw 31 used to lock the mounting bracket 28, and accordingly the entire pusher hook 10 due to the common mounting of the hook 18, support wire 24, and security frame 26 to the mounting bracket 28, to a particular retail structures.

Figure 12:
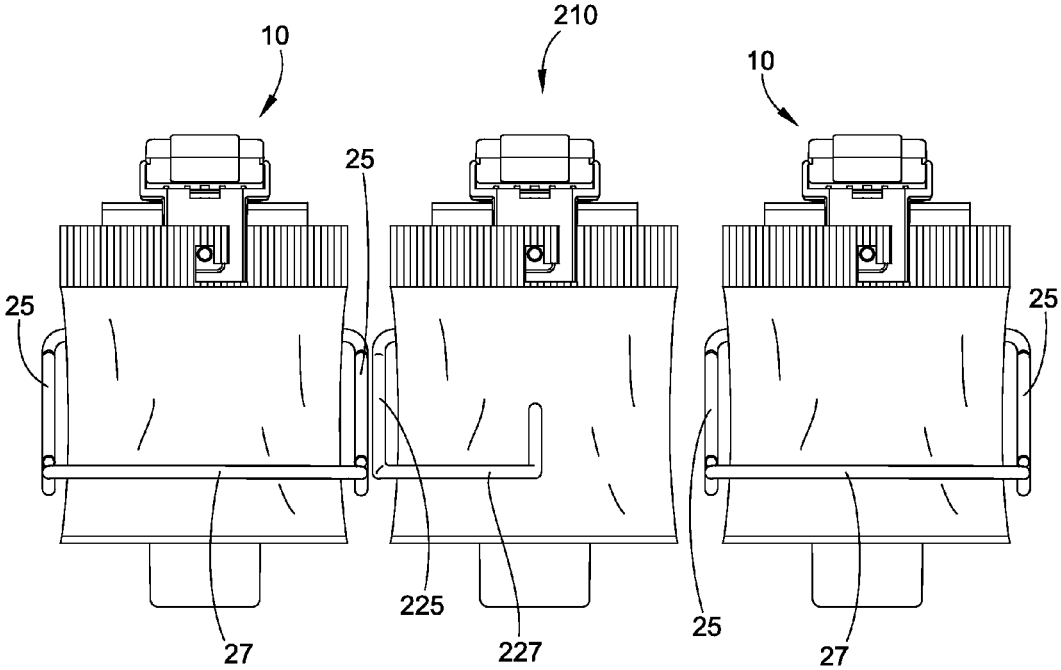
FIG. 12 is a front view of an alternative embodiment of the pusher hook of FIG. 1 situated between two adjacent pusher hooks of FIG. 1.

With reference to FIG. 12, an alternative embodiment of a pusher hook 210 is illustrated. In the illustrated embodiment, the pusher has at least one product retainer 225, and a front stop 227 extending way from the product retainer 225. The product retainer 225 functions in a similar manner to the product retainers 25 described above in that it generally restricts lateral movement of retail merchandise carried by the pusher hook 210.

The wire segment forming the front stop 227 has a generally L-shaped profile. However, other configurations of the front stop 227 are contemplated. For example, the front stop 227 could be a horizontal member such as the adjacent front stops 27 of FIG. 12.

Upon examination of FIG. 12 it will be recognized that security and loss prevention is enhanced when the pusher hook 210 is situated between two adjacent pusher hooks 10 as described above. More particularly, the product retainers 25, 225 will cooperate such that merchandise carried by the pusher hook 210 is generally restricted from lateral removal from the pusher hook 10.

As described herein, the pusher hook 10 provides an accessible and aesthetically pleasing arrangement of merchandise on a retail hook 18. The pusher hook 10 further incorporates a security frame 26 to reduce or eliminate the ability to remove items of merchandise laterally from the retail hook 18. Furthermore, the security frame 26 also holds the retail merchandise 14 in a generally vertical or upright orientation such that it does not have an undesirable forward lean.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise hook, comprising:

a hook for hanging retail merchandise therefrom;

a front stop separate from and arranged in spaced relation to the hook;

a pusher movable relative to the hook and operable to bias retail merchandise hanging from the hook into engagement with the front stop;

a track positioned above and separate from the hook, the track comprising a pair of opposed sidewalls, a top wall, and a bottom wall, wherein at least one of the opposed sidewalls and bottom wall includes a groove formed thereon, the groove providing a slide surface into which a track retainer of the pusher is received;

wherein the front stop is disposed below the hook;

a mounting bracket, the hook and the front stop being provided by separate wire structures that are commonly affixed to the mounting bracket, the hook extending from the mounting bracket and terminating in a first distal end, the front stop extending from the mounting bracket and terminating in a second distal end, wherein the first distal end extends beyond the second distal end relative to the mounting bracket;

wherein the wire structure for the front stop has laterally spaced product retainers, one on each opposed lateral side of the hook, the product retainers extending toward the front stop, the product retainers arranged to prevent or limit lateral movement of product hanging on the hook while permitting forward and backward movement of product on the hook; and wherein the laterally spaced product retainers each include a top wire segment and a bottom wire segment extending between a back end and the front stop, the front stop being a front wire segment extending laterally between the product retainers, and wherein the top and bottom segments generally converge and thereby diminish a span of the product retainers as the top and bottom segments extend from the back end toward the front stop.

2. The retail merchandise hook of claim 1 further including a track support structure arranged in spaced relation to the hook, the track support structure supporting the track.

3. The retail merchandise hook of claim 2 wherein the track support structure comprises a separately formed wire structure that is disposed above the hook, the track and the hook being commonly joined to the mounting bracket.

4. A retail merchandise hook, comprising:

a hook for hanging retail merchandise therefrom;

a front stop separate from and arranged in spaced relation to the hook;

a pusher movable relative to the hook and operable to bias retail merchandise hanging from the hook into engagement with the front stop; and a track positioned above and separate from the hook, the track comprising a pair of opposed sidewalls, a top wall, and a bottom wall, wherein at least one of the opposed sidewalls and bottom wall includes a groove formed thereon, the groove providing a slide surface into which a track retainer of the pusher is received a track support structure arranged in spaced relation to the hook, the track support structure supporting the track;

wherein the track support structure comprises a separately formed wire structure that is disposed above the hook, the track and the hook being commonly joined to a common mounting bracket; and wherein the separately formed wire structure forms a wire loop, and wherein the track surrounds the separately formed wire loop to define an interior space of the track, wherein a coiled spring is carried by the pusher and has a free end which is affixed to a generally flat surface of the bottom wall of the track.

5. The retail merchandise hook of claim 4 wherein the front stop is disposed below the hook.

6. The retail merchandise hook of claim 5 further comprising the hook and the front stop being provided by separate wire structures that are commonly affixed to the mounting bracket, the hook extending from the mounting bracket and terminating in a first distal end, the front stop extending from the mounting bracket and terminating in a second distal end, wherein the first distal end extends beyond the second distal end relative to the mounting bracket.

7. The retail merchandise hook of claim 6 wherein the wire structure for the front stop has laterally spaced product retainers, one on each opposed lateral side of the hook, the product retainers extending toward the front stop, the product retainers arranged to prevent or limit lateral movement of product hanging on the hook while permitting forward and backward movement of product on the hook.

8. The retail merchandise hook of claim 5 wherein the front stop is provided by a bin extending from the mounting bracket, the hook and bin commonly affixed to the mounting bracket, the bin having a bottom and a pair of laterally spaced product retainers on opposed sides of the hook, the product retainers arranged to prevent or limit lateral movement of product hanging from the hook while permitting forward and backward movement of product hanging from the hook.

9. A retail merchandise hook, comprising:

a hook for hanging retail merchandise therefrom;

a front stop separate from and arranged in spaced relation to the hook;

a pusher movable relative to the hook and operable to bias retail merchandise hanging from the hook into engagement with the front stop;

a track positioned above and separate from the hook, the track comprising a pair of opposed sidewalls, a top wall, and a bottom wall, wherein at least one of the opposed sidewalls and bottom wall includes a groove formed thereon, the groove providing a slide surface into which a track retainer of the pusher is received;

a track support structure arranged in spaced relation to the hook, the track support structure enveloped by the track;

wherein the track support structure comprises a separately formed wire structure that is disposed above the hook, the track and the hook being commonly joined to a common mounting bracket;

wherein the separately formed wire structure forms a wire loop, and wherein the track surrounds the separately formed wire loop to define an interior space of the track, wherein a coiled spring is carried by the pusher and has a free end which is affixed to a generally flat surface of the bottom wall of the track;

a security structure configured to restrict side removal of retail merchandise from the hook to removal from an end of the hook, the security structure including at least one product retainer disposed on at least one lateral side of the hook, and extending at least partially below the hook, the at least one product retainer arranged to establish a perimeter limited to around the front, back, and opposed sides of one or more items of retail merchandise positioned on the hook.

10. The retail merchandise hook of claim 9, wherein the at least one product retainer converges with a diminishing vertical span as the at least one product retainer extends from a back end toward a front end.

11. The retail merchandise hook of claim 9, wherein the hook and the security structure are commonly affixed to the common mounting bracket.

12. The retail merchandise hook of claim 9, wherein the front stop is provided by the security structure in spaced relation to and below a front end of the hook.

13. The retail merchandise hook of claim 12, further comprising the hook and the front stop being provided by separate wire structures that are commonly affixed to the mounting bracket.

14. The retail merchandise hook of claim 13, wherein the at least one product retainer includes first and second laterally spaced product retainers each having a top wire segment and a bottom wire segment extending between a back end and the front stop, the front stop being a front wire segment extending laterally between the first and second product retainers, and wherein the top and bottom segments generally converge and thereby diminish a span of the first and second product retainers as the top and bottom segments extend from the back end toward the front stop.

15. The retail merchandise hook of claim 12, wherein the security structure is a bin having a bottom and a front wall, the at least one product retainer and front wall extending upwardly from the bottom, the front stop provided by the front wall.

16. A retail merchandise hook, comprising:

a hook for hanging retail merchandise therefrom;

a front stop in spaced relation to the hook and arranged to stop retail merchandise proximate a front end of the hook;

a pusher assembly comprising a support structure above the hook, a housing surrounding the support structure, and a pusher housing a spring therein, the housing defining at least one track with a slide surface along which the pusher is linearly translatable, the pusher acted upon by the spring to urge the pusher toward the front stop;

a mounting bracket, the hook and the support structure are commonly carried by the mounting bracket; and wherein the support structure is a wire loop that is disposed above the hook and enveloped by the housing in an interior space of the housing, wherein the spring includes a free end which is affixed to a generally flat bottom surface of the housing.

17. The retail merchandise hook of claim 16, wherein the pusher includes a plurality of track retainers, at least one of which extends into a space bounded by the wire loop and interior to the housing.

18. The retail merchandise hook of claim 16 further comprising a security structure configured to restrict side removal of retail merchandise from the hook to removal from an end of the hook, the security structure commonly carried by the mounting bracket with the support structure and the hook.

* * * * *